US011944251B2

(12) United States Patent
Eisenbart et al.

(10) Patent No.: US 11,944,251 B2
(45) Date of Patent: Apr. 2, 2024

(54) DOMESTIC DISHWASHER

(71) Applicant: BSH Hausgeräte GmbH, Munich (DE)

(72) Inventors: Bernd Eisenbart, Holzheim (DE); Michael Georg Rosenbauer, Reimlingen (DE); Michael Rupp, Holzheim (DE); Aaron Friedke, Gundelfingen (DE); Martin Stickel, Giengen (DE)

(73) Assignee: BSH Hausgeräte GmbH, Munich (DE)

( * ) Notice: Subject to any disclaimer, the term of this patent is extended or adjusted under 35 U.S.C. 154(b) by 199 days.

(21) Appl. No.: 17/628,580

(22) PCT Filed: Jul. 16, 2020

(86) PCT No.: PCT/EP2020/070096
§ 371 (c)(1),
(2) Date: Jan. 20, 2022

(87) PCT Pub. No.: WO2021/018607
PCT Pub. Date: Feb. 4, 2021

(65) Prior Publication Data

US 2022/0248935 A1 Aug. 11, 2022

(30) Foreign Application Priority Data

Jul. 31, 2019 (DE) ..... 10 2019 211 400.8

(51) Int. Cl.
*A47L 15/23* (2006.01)
*A47L 15/42* (2006.01)

(52) U.S. Cl.
CPC ..... *A47L 15/23* (2013.01); *A47L 15/4246* (2013.01); *A47L 15/4221* (2013.01); *A47L 2501/20* (2013.01)

(58) Field of Classification Search
CPC .. A47L 15/23; A47L 15/4221; A47L 15/4246; A47L 2501/20
See application file for complete search history.

(56) References Cited

U.S. PATENT DOCUMENTS 5,700,329 A 12/1997 Edwards
2004/0069332 A1* 4/2004 LeBaron ..... A47L 15/23 134/179

(Continued)

FOREIGN PATENT DOCUMENTS

CN 105167730 A * 12/2015
EP 0068974 A1 1/1983

OTHER PUBLICATIONS

CN105167730A machine translation (Year: 2015).*
International Serach Report PCT/EP2020/070096 dated Sep. 2, 2020.

*Primary Examiner* — Douglas Lee
(74) *Attorney, Agent, or Firm* — Michael E. Tschupp; Andre Pallapies; Brandon G. Braun

(57) ABSTRACT

A household dishwasher includes a washing container having a floor, and a spray arm supported for rotation about an axis of rotation and including spray nozzles for applying washing liquor and/or fresh water to a dishwasher load received in the washing container. The spray arm is designed so as to be capable of being disassembled and re-assembled along the axis of rotation, in order to transfer the spray arm from a first mode, in which the spray nozzles point away from the floor, into a second mode, in which the spray nozzles point toward the floor, and vice versa.

11 Claims, 5 Drawing Sheets

(56) References Cited

U.S. PATENT DOCUMENTS

| | | | | |
|---|---|---|---|---|
| 2004/0163685 | A1* | 8/2004 | Roh | A47L 15/4282<br>134/179 |
| 2004/0195361 | A1* | 10/2004 | Kim | B05B 3/026<br>239/225.1 |
| 2010/0139719 | A1* | 6/2010 | Gnadinger | A47L 15/23<br>134/199 |
| 2017/0332877 | A1* | 11/2017 | Pers | A47L 15/0047 |

* cited by examiner

DOMESTIC DISHWASHER

CROSS-REFERENCES TO RELATED APPLICATIONS

This application is the U.S. National Stage of International Application No. PCT/EP2020/070096, filed Jul. 16, 2020, which designated the United States and has been published as International Publication No. WO 2021/018607A1 and which claims the priority of German Patent Application, Serial No. 10 2019 211 400.8, filed Jul. 31, 2019, pursuant to 35 U.S.C. 119(a)-(d).

The contents of International Application No. PCT/EP2020/070096 and German Patent Application, Serial No. 10 2019 211 400.8 are incorporated herein by reference in their entireties as if fully set forth herein.

BACKGROUND OF THE INVENTION

The present invention relates to a household dishwasher.

A dishwasher comprises a washing container, in which a dishwasher load to be cleaned can be received. A rotatable spray arm can be provided in the washing container, with the aid of which a dishwasher load received in the washing container can be applied with washing liquor and/or fresh water. The washing container comprises a floor, on which a screening system is provided. When the dishwasher is used, the screening system becomes blocked with impurities over time and must be cleaned manually.

US 2004/0163685 A1 describes a dishwasher with a spray arm attached below an upper basket. The spray arm comprises spray arm sections which can be rotated at right angles to an axis of rotation of the spray arm, in order to feed washing liquor and/or fresh water alternatively to the upper basket or a lower basket of the dishwasher.

BRIEF SUMMARY OF THE INVENTION

Against this background, an object of the present invention consists in making available an improved household dishwasher.

Accordingly, a household dishwasher is proposed with a washing container, which has a floor, and a spray arm, supported rotatably about an axis of rotation, with spray nozzles for applying washing liquor and/or fresh water to a dishwasher load received in the washing container. Here the spray arm can be disassembled and re-assembled along the axis of rotation in order to transfer the spray arm from a first mode, in which the spray nozzles point away from the floor, into a second mode, in which the spray nozzles point toward the floor, and vice versa.

As a result of it being possible to easily disassemble and re-assemble the spray arm, the additional function of an improved screen cleaning can be achieved, for instance, if the spray arm is in the second mode and the spray nozzles point toward the floor. An intelligible and comprehensible principle results for a user by turning the spray arm. In particular, weak points in the screening system can be specifically cleaned in a significantly better manner by suitably aligning the spray nozzles.

In addition to the floor, the washing container preferably comprises a ceiling arranged facing the floor, a hinged door, a rear wall arranged facing the closed door and a two side walls. The spray arm is preferably provided on the floor. The spray arm can, however, also be attached to a receptacle for the dishwasher load. In particular, the household dishwasher comprises a plurality of receptacles for the dishwasher load, such as, for instance, a lower basket, an upper basket and a cutlery basket. The receptacles for the dishwasher load can be moved in and out of the washing container. Here the axis of rotation can be the axis of rotation of a spray arm satellite of the spray arm or the axis of rotation of the spray arm.

The fact that the spray arm can be disassembled and re-assembled "along" the axis of rotation is understood to mean in particular that the spray arm or the spray arm satellite can be attached and removed again as often as required along the alignment of the axis of rotation. In other words, the spray arm is turned as a complete component in order to bring the same from the first mode into the second mode and vice versa. In particular, individual components, such as for instance individual arms, of the spray arm or of the spray arm satellite are not disassembled and assembled. In the first mode, the spray nozzles are directed away from the floor toward one of the receptacles for the dishwasher load, for instance. In other words, the spray nozzles apply the dishwasher load with washing liquor and/or fresh water. In the second mode, the spray nozzles are pointing toward the floor. In this case, a screening system provided on the floor can be cleaned with the aid of the spray nozzles. In the event that the spray arm is attached to a receptacle for a dishwasher load, in particular to an upper basket, in the second mode for instance the spray arm can also clean a lower basket arranged below the upper basket. What are known as intensive washing zones can be realized here.

According to a further embodiment, the spray arm comprises a beam and a spray arm satellite supported rotatably on the beam, wherein the spray arm satellite has the spray nozzles, and wherein the spray arm satellite can either be assembled on the beam in the first mode or in the second mode.

The beam is preferably supported rotatably on a sump of the household dishwasher. The beam has two arms, for instance, wherein the spray arm satellite is supported rotatably on one of the two arms. The spray arm satellite is connected to the beam with the aid of a fastening element, for instance. The fastening element can be released in order to disassemble the spray arm, for instance. The spray arm satellite preferably comprises a number of arms. For instance, the spray arm satellite can have three arms, which are arranged offset to one another by an angle of in each case 120°. The number of arms is however basically arbitrary. Alternatively, the spray arm or the spray arm satellite is connected directly and without an additional fastening element to one of the receptacles for the dishwasher load or to the beam.

According to a further embodiment, an axis of rotation of the beam and an axis of rotation of the spray arm satellite are arranged parallel to and at a distance from one another.

In other words, the axis of rotation of the beam does not match the axis of rotation of the spray arm satellite. The distance between the two axes of rotation can amount to several centimeters.

According to a further embodiment, the spray arm satellite is recoil driven with the aid of the washing liquor and/or the fresh water.

"Recoil driven" is understood here to mean that the spray arm satellite has spray nozzles, which are suited to rotating the spray arm satellites, by revealing these spray jets. To this end, special drive spray nozzles can also be provided here, for instance.

According to a further embodiment, the spray arm is driven actively, or the spray arm is recoil driven with the aid of the washing liquor and/or the fresh water.

The fact that the spray arm is driven "actively" is to be understood here to mean that the spray arm has a drive device, for instance comprising an electric motor. In particular, the beam of the spray arm is driven actively. The spray arm satellite can be brought into a desired position, for instance, in order to achieve a particularly thorough cleaning of the screening system or to create an intensive cleaning zone. In the event of the spray arm being recoil driven with the aid of the washing liquor and/or the fresh water, this has, for instance, the spray nozzles or special drive spray nozzles, in order to rotate the spray arm.

According to a further embodiment, the spray arm can be transferred into the first mode and into the second mode with the aid of a bayonet lock, with the aid of a threaded lock or with the aid of a snap-fit connection.

To this end, a fastening element, as mentioned previously, can be provided. The spray arm can be connected to one of the receptacles for the dishwasher load, in particular to an upper basket or to the beam with the aid of the fastening element, the part of a bayonet lock, a threaded lock or a snap-fit connection. Alternatively, the spray arm or the spray arm satellite is connected directly and without an additional fastening element to one of the receptacles for the dishwasher load or to the beam.

According to a further embodiment, the spray arm can be transferred into the first mode or into the second mode with the aid of a valve.

To this end, the spray arm can have spray nozzles on the top and bottom side, for instance, which can be switched off and on with the aid of the valve. The valve can comprise a punched tape, for instance. The valve is optional.

According to a further embodiment, the household dishwasher further comprises a screening system, which can be applied with washing liquor and/or fresh water in order to clean the same with the aid of the spray arm located in the second mode.

The screening system is in several parts. The screening system can comprise a wide-mesh screen and a fine-mesh screen. The screening system is preferably suited to covering the sump.

According to a further embodiment, the spray arm is supported rotatably on a sump of the household dishwasher.

To this end, a plain bearing can be provided, for instance. A tube-shaped sump dome, in which the beam of the spray arm is rotatably supported, is preferably provided on the sump.

According to a further embodiment, the spray arm is supported rotatably on a receptacle for the dishwasher load of the household dishwasher.

A number of receptacles for the dishwasher load can be provided. For instance, one of the spray arms can be provided on the upper basket and the other spray arm can be provided on the floor. In other words, the household dishwasher can comprise a number of spray arms.

Further possible implementations of the household dishwasher also comprise not explicitly cited combinations of features or embodiments described previously or below in respect of those in the exemplary embodiments. Here the person skilled in the art will also add individual aspects as improvements or additions to the respective basic form of the household dishwasher.

BRIEF DESCRIPTION OF THE DRAWINGS

Further advantageous embodiments and aspects of the household dishwasher form the subject matter of the subclaims and the exemplary embodiments of the household dishwasher described below. Furthermore, the household dishwasher is explained in more detail below on the basis of preferred embodiments with reference to the appended figures.

DETAILED DESCRIPTION OF EXEMPLARY EMBODIMENTS OF THE PRESENT INVENTION

Figure 1:
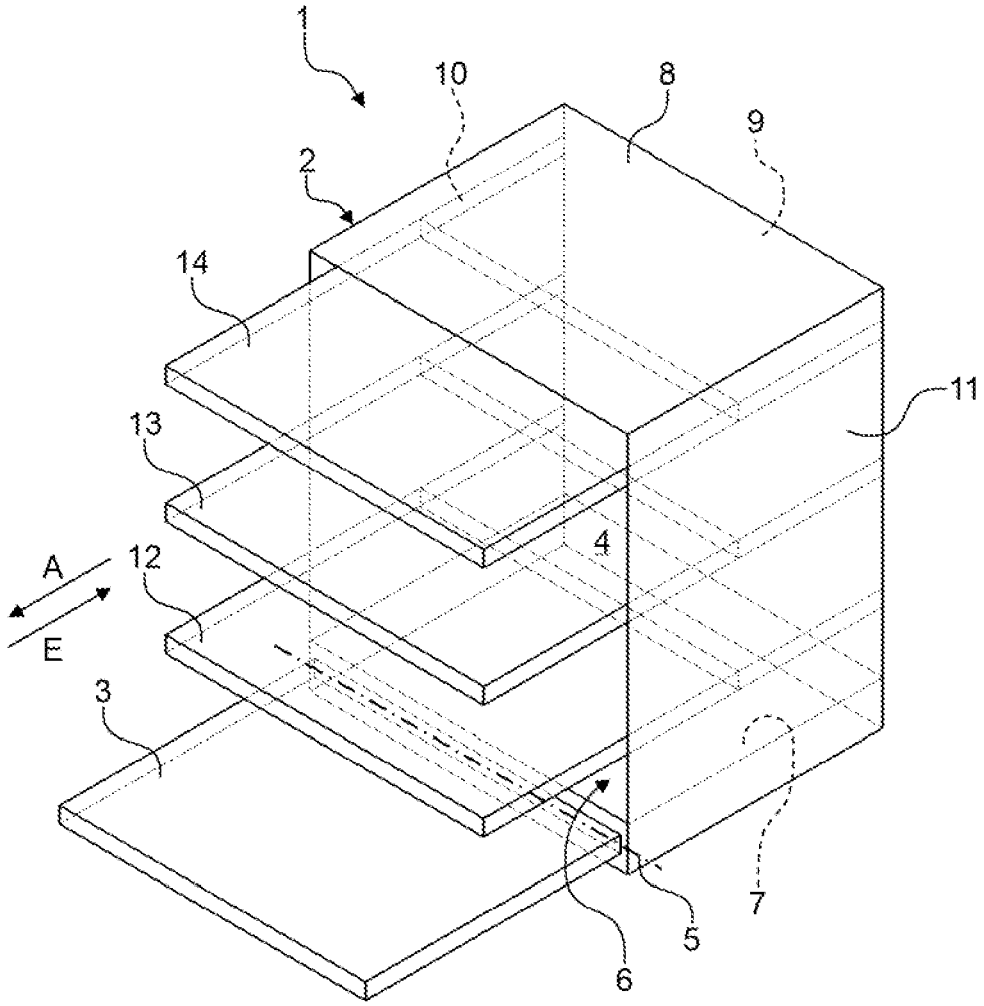
FIG. 1 shows a schematic perspective view of an embodiment of a household dishwasher.

Identical or functionally identical elements are provided with the same reference characters in the figures unless otherwise stated.

FIG. 1 shows a schematic perspective view of an embodiment of a household dishwasher 1. The household dishwasher 1 comprises a washing container 2, which can be closed by a door 3, in particular in a water-tight manner. To this end, a sealing device can be provided between the door 3 and the washing container 2. The washing container 2 is preferably cuboid. The washing container 2 can be arranged in a housing of the household dishwasher 1. The washing container 2 and the door 3 can form a washing compartment 4 for washing the dishwasher load.

In FIG. 1, the door 3 is shown in its opened position. The door 3 can be closed or opened by pivoting about a swivel axis 5 provided on a lower end of the door 3. A loading opening 6 of the washing container 2 can be closed or opened with the aid of the door 3. The washing container 2 has a floor 7, a ceiling 8 arranged facing the floor 7, a rear wall 9 arranged facing the closed door 3 and two side walls 10, 11 arranged facing one another. The floor 7, the ceiling 8, the rear wall 9 and the side walls 10, 11 can be manufactured from stainless steel sheet, for instance. Alternatively, the floor 7 can be manufactured from a plastic material, for instance.

The household dishwasher 1 further has at least one receptacle for the dishwasher load 12 to 14. A number of, for instance three, receptacles for the dishwasher load 12 to 14 can preferably be provided, wherein the receptacle for the dishwasher load 12 can be a lower receptacle for the dishwasher load or a lower basket, the receptacle for the dishwasher load 13 an upper receptacle for the dishwasher load or an upper basket and the receptacle for the dishwasher load 14 a cutlery drawer. As FIG. 1 also shows, the receptacles for the dishwasher load 12 to 14 are arranged one above the other in the washing container 2. Each receptacle for the dishwasher load 12 to 14 can alternatively be moved in or out of the washing container 2. In particular, each receptacle for the dishwasher load 12 to 14 can be moved in or out of the washing container 2 in an insertion direction E and contrary to the insertion direction E can be pulled or moved out of the washing container 2 in a pull-out direction A.

Figure 2:
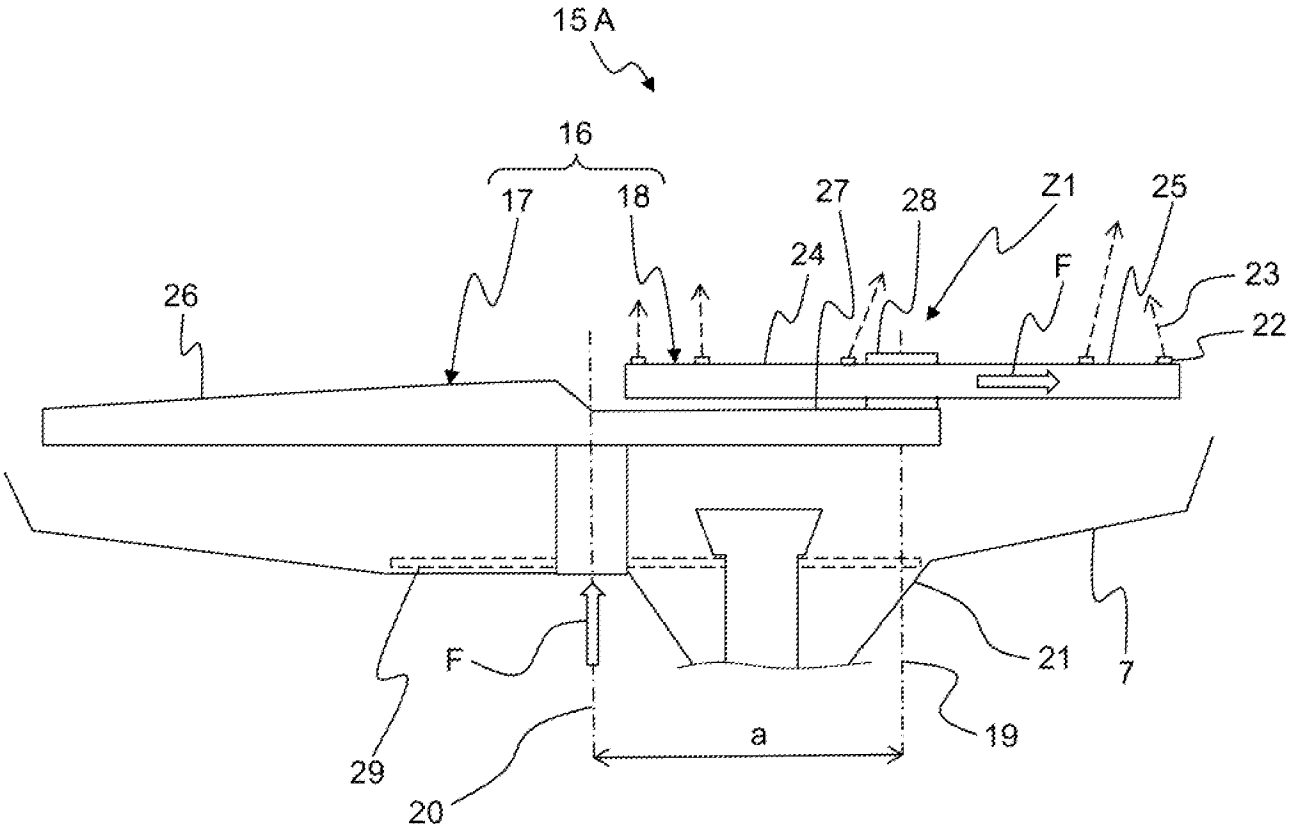
FIG. 2 shows a schematic side view of an embodiment of a spray apparatus for the household dishwasher according to FIG. 1.

FIG. 2 shows a schematic side view of an embodiment of a spray apparatus 15A for the household dishwasher 1. The spray apparatus 15A is preferably provided on the floor 7 of the washing container 2. The spray apparatus 15A comprises a rotatably supported spray arm 16 with a beam 17 and a spray arm satellite 18 supported rotatably on the beam 17. The spray arm satellite 18 is supported rotatably about an axis of rotation 19 on the beam 17. The beam 17 is in turn supported rotatably about an axis of rotation 20 on a sump 21 of the household dishwasher 1.

The spray arm satellite 18 comprises a plurality of spray nozzles 22, of which only one is provided with a reference character in FIG. 2, however. The spray nozzles 22 are suited to generating spray jets 23, with the aid of which the dishwasher load can be applied with washing liquor and/or fresh water F. The spray arm satellite 18 has a number of arms 24, 25. The number of arms 24, 25 is arbitrary. For instance, three arms 24, 25 of this type are provided, which are arranged at a distance from one another about a peripheral angle of 120°. The spray nozzles 22 are preferably provided on one side of the spray arm satellite 18.

In particular, the spray nozzles 22 are provided on the top of the spray arm satellite 18. Alternatively, the spray nozzles 22 can also be arranged so that these point in the direction of the floor 7. Alternatively, the spray arm satellite 18 can also have spray nozzles 22 on the top side and bottom side. The beam 17 preferably comprises a number of arms 26, 27. Two arms 26, 27 are preferably provided, wherein the spray arm satellite 18 is supported rotatably about the axis of rotation 19 on the arm 27. FIG. 2 shows the spray arm 16 in a first mode Z1, in which the spray nozzles 22 of the spray arm satellite 18 are pointing away from the floor 7.

Figure 3:
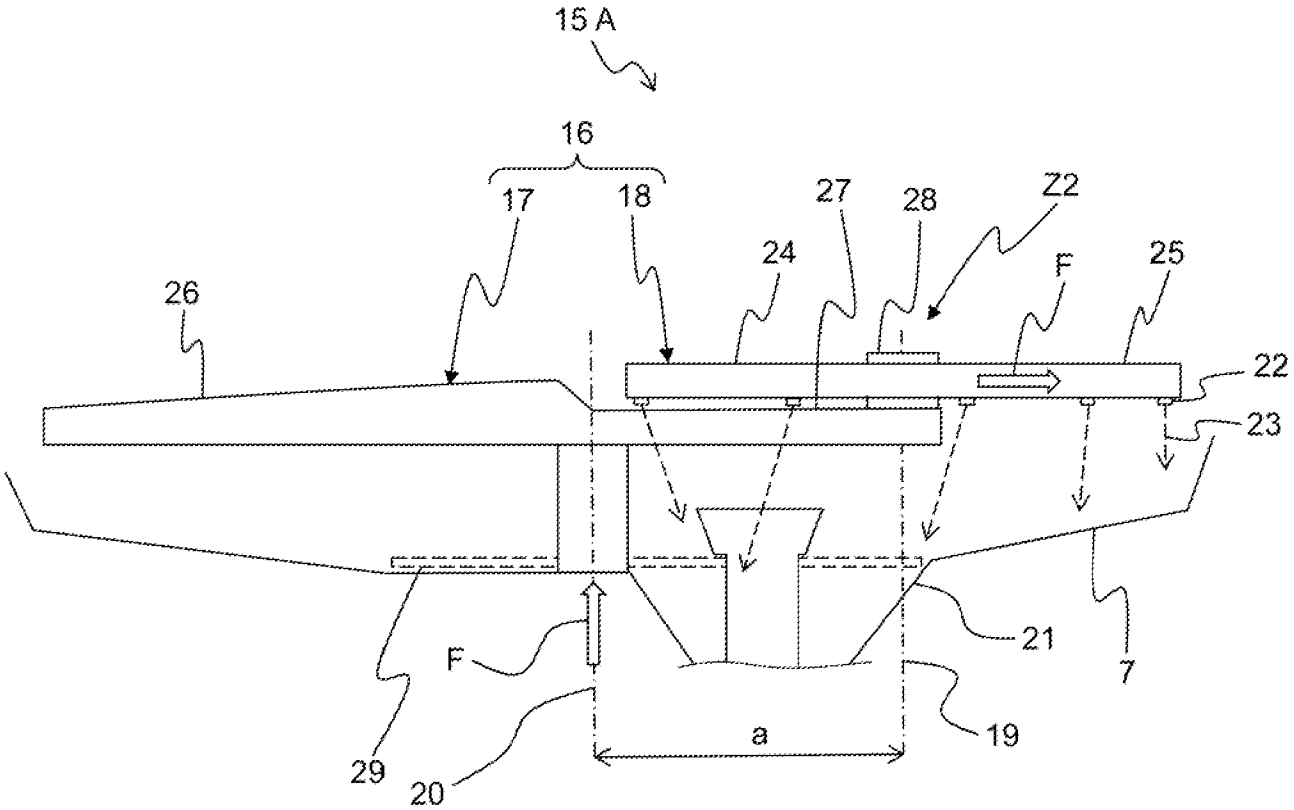
FIG. 3 shows a further schematic side view of the spray apparatus according to FIG. 2.

A connection between the spray arm satellite 18 and the beam 17 is designed to be detachable. In particular, the connection can be released without a tool. For instance, a bayonet lock, a threaded lock or a snap-fit connection can be provided between the spray arm satellite 18 and the beam 17. For instance, a detachable fastening element 28 can be provided, with the aid of which the spray arm satellite 18 can be connected to the beam 17 and separated again herefrom. The spray arm satellite 18 can therefore be easily assembled and disassembled. In particular, the spray arm satellite 18 can be transferred from the first mode Z1, shown in FIG. 2, in which the spray nozzles 22 point away from the floor 7, into a second mode Z2 shown in FIG. 3, in which the spray nozzles 22 point toward the floor 7. The spray arm satellite 18 can therefore be supported rotated about 180°.

A screening system 29 is provided on the sump 21. The screening system 29 is made of several parts and can comprise a wide-mesh screen and a fine-mesh screen, for instance. In the second mode Z2, the spray nozzles 22 are suited to applying the screening system 29 with washing liquor and/or fresh water F, in order to clean the same. In the first mode Z1, by contrast, the spray nozzles 22 are directed toward the receptacle for the dishwasher load 12 of the household dishwasher 1, in order to clean the dishwasher load received herein.

The axes of rotation 19, 20 are positioned parallel to one another and at a distance from one another. In particular, the axes of rotation 19, 20 are positioned at a distance a from one another. The beam 17 can likewise have the previously mentioned spray nozzles 22. This is not mandatory, however. The beam 17 is driven actively. Here "driven actively" is understood to mean that a drive device, for instance in the form of an electric motor, is assigned to the spray arm 16, in particular the beam 17, which is suited to rotating the beam 17 about the axis of rotation 20.

Contrary hereto, the spray arm satellite 18 is not driven actively. In particular, the spray arm satellite 18 is rotated by the spray jets 23 pouring out of the spray nozzles 22. Special drive spray nozzles can also be provided.

The spray arm satellite 18 can be easily disassembled by a user for, for instance, a machine cleaning cycle or a special screen cleaning function and in the second mode Z2 can conversely be supported on the beam 17. While, during the cleaning operation, the spray nozzles 22 are preferably directed upward in the direction of the receptacles for the dishwasher load 12 to 14, in order thus to clean the dishwasher load, in the second mode Z2 the spray nozzles 22 are directed downward in the direction of the screening system 29, in order to be able to intensively clean the screening system 29.

The alignment of the spray nozzles 22 can be adjusted so that in particular weak points, such as for instance countersunk or concealed geometries of the screening system 29, are struck by the spray jets 23 and as a result can be better cleaned. As previously mentioned, the beam 17 is driven actively. The beam 17 can therefore be controlled in its position. In this case, the position controller can move the spray arm satellite 18 in a targeted manner into one or more desired positions, in particular intensive cleaning zones, above the screening system 29, in order to better strike this and in particular weak points, such as concealed or countersunk geometries of the screening system 29, with the spray jets 23, and thus to better clean the screening system 29.

An additional function of the improved cleaning of the screening system 29 is therefore possible without additional components and costs. An intelligible and comprehensible principle is produced for a user. As a result of a suitable alignment of the spray nozzles 22 and in the expansion of the targeted positioning of the spray arm satellite 18, weak points in particular in the screening system 29 can be cleaned in a significantly improved manner. Furthermore, by means of the targeted positioning of the beam 17, intensive washing zones can also be realized in or on the receptacles for the dishwasher load 12 to 14.

Figure 4:
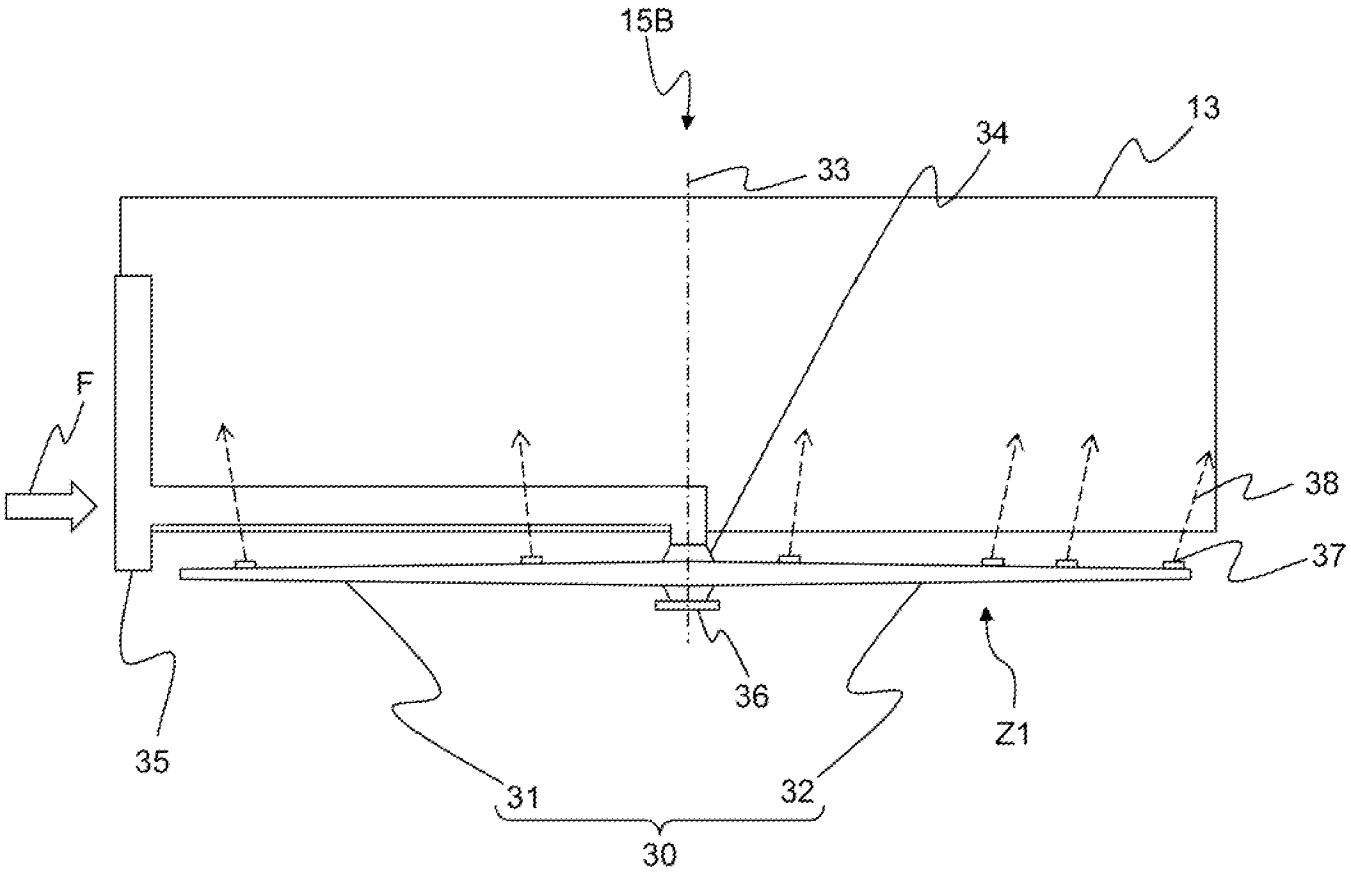
FIG. 4 shows a schematic side view of a further embodiment of a spray apparatus for the household dishwasher according to FIG. 1.
Figure 5:
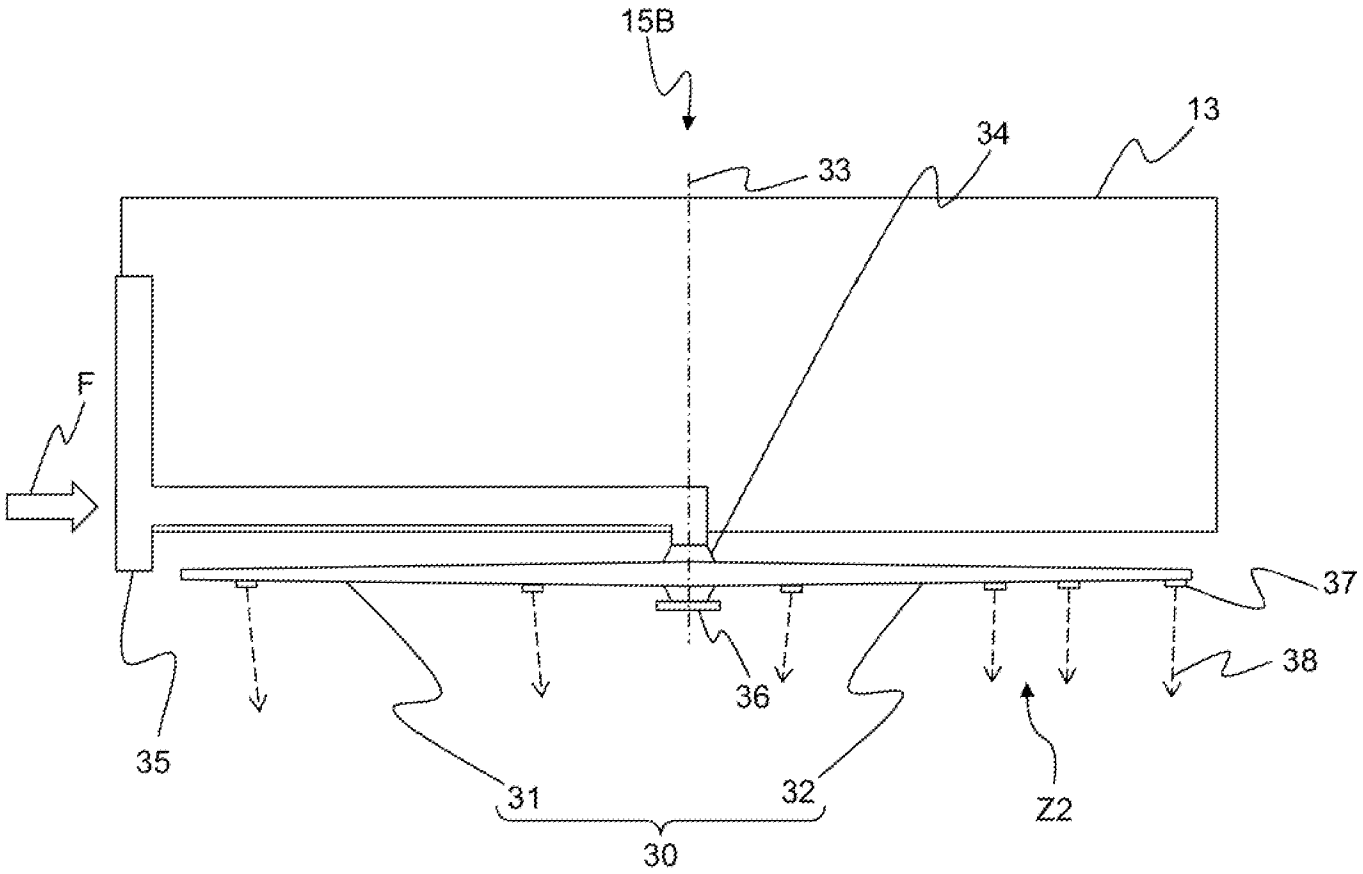
FIG. 5 shows a further schematic side view of the spray apparatus according to FIG. 4.

FIGS. 4 and 5 show in each case a schematic side view of a further embodiment of a spray apparatus 15B for the household dishwasher 1. The household dishwasher 1 can have both spray apparatuses 15A, 15B. In FIGS. 4 and 5, the receptacle for the dishwasher load 13 embodied as an upper basket is shown. A spray arm 30 is supported rotatably below the receptacle for the dishwasher load 13. The spray arm 30 can have two arms 31, 32, for instance, wherein the spray arm 30 is supported rotatably about an axis of rotation 33 on the receptacle for the dishwasher load 13. Contrary to the spray arm 16 of the spray apparatus 15A, the spray arm 30 is not driven actively, but instead passively, in other words with the aid of the washing liquor and/or the fresh water F.

A support 34 is provided on the receptacle for the dishwasher load 13, with the aid of which the spray arm 30 is supported in a rotatable manner on the receptacle for the dishwasher load 13. Furthermore, an infeed tube 35 can be provided, with the aid of which washing liquor and/or fresh water F is fed to the spray arm 30. The spray arm 30 comprises a fastening element 36, for instance a bayonet lock or a snap-fit connection. The spray arm 30 can be assembled and disassembled with the aid of the fastening element 36.

As FIG. 4 shows, the spray arm 30 is in a first mode Z1, in which spray nozzles 37 of the spray arm 30 are aligned in the direction of the receptacle for the dishwasher load 13 and thus away from the floor 7. The spray arm 30 can be rotated with the aid of spray jets 38. To this end, special drive spray nozzles can also be provided. As a result, the spray arm 30 can be easily disassembled, rotated about 180° and reassembled, but depending on user wishes, either the lower basket in the form of the receptacle for the dishwasher load 12 or the upper basket in the form of the receptacle for the dishwasher load 13 can be cleaned. The configuration desired by the user in the form of the two modes Z1, Z2 is achieved accordingly by a manual rotation of the spray arm 30. If the spray arm 30 is set to clean the receptacle for the dishwasher load 12, an intensive washing zone is as a result realized in the receptacle for the dishwasher load 12, since the entire hydraulic removal rate of the household dishwasher 1 is therefore concentrated on the receptacle for the dishwasher load 12.

In terms of washing, it makes sense to identify the mode Z1, Z2 in which the spray arm 30 is currently located, in order then also to deactivate the washing liquor, and/or fresh water/time distribution between the spray arm 30 and a lower spray arm, for instance in the form of the spray arm 16, and possibly also a roof sprinkler or to adjust a temperature profile of a washing program. The installation position of the spray arm 30 or the spray arm satellite 18 can be achieved for instance by way of acoustic sensors, camera detection, concentricity detection of a circulation pump of the household dishwasher 1 or a measurement of the volume current.

Alternatively, it is also possible to realize the transfer of the spray arm 30 from the first mode Z1 into the second mode Z2 by means of a manually adjustable valve. In this case, the spray arm 30 has spray nozzles 37 on the top and bottom side, wherein only one cleaning direction, in particular in the direction of the receptacle for the dishwasher load 13 or the direction of the receptacle for the dishwasher load 12, is ever activated. In the initial mode of the household dishwasher 1, the spray nozzles 37 would in this case preferably be set to a cleaning of the receptacle for the dishwasher load 13 and can be switched over to a cleaning of the receptacle for the dishwasher load 12 by means of manually actuating the valve. In design terms, a valve of this type can be realized for instance by means of a punched tape, which is moved in and out, in order thus to change the spray direction.

If the user is to select a cleaning program without an intensive zone during a subsequent washing cycle, he is requested before the start to actively confirm the deactivation of the intensive zone and thus the reset of the spray arm 30 to upper basket cleaning. This is used to ensure that it is kept in mind to reset the spray arm 30 back into the original setting in the form of the first mode Z1. In the case of the activated intensive zone, it can be communicated to the user that the receptacle for the dishwasher load 13 is not permitted to be loaded because the receptacle for the dishwasher load 13 is not cleaned. This can take place visually for instance by means of prominent lettering, by means of an automatic fold-out lever, which blocks the loading of the receptacle for the dishwasher load 13, or by means of an additional options button.

Although the present invention has been described on the basis of exemplary embodiments, it can be modified in various ways.

What is claimed is:

1. A household dishwasher, comprising:

a washing container having a floor; and a spray arm supported for rotation about an axis of rotation and including spray nozzles for applying washing liquor and/or fresh water to a dishwasher load received in the washing container, said spray arm being designed so as to be capable of being disassembled and re-assembled along the axis of rotation, in order to transfer the spray arm from a first mode, in which the spray nozzles point away from the floor, into a second mode, in which the spray nozzles point toward the floor, and vice versa, wherein the spray arm is configured to turn as a complete component to adjust the spray arm from the first mode to the second mode.

2. The household dishwasher of claim 1, wherein the spray arm comprises a beam and a spray arm satellite which is supported rotatably on the beam, said spray nozzles being provided on the spray arm satellite, said spray arm satellite being designed for support on the beam either in the first mode or in the second mode.

3. The household dishwasher of claim 2, wherein the beam is rotatable about an axis of rotation which is arranged parallel to and at a distance to an axis of rotation of the spray arm satellite.

4. The household dishwasher of claim 2, wherein the spray arm satellite is recoil driven with the aid of the washing liquor and/or the fresh water.

5. The household dishwasher of claim 1, further comprising a drive device operably connected to the spray arm to actively drive the spray arm.

6. The household dishwasher of claim 1, wherein the spray arm is recoil driven with the aid of the washing liquor and/or the fresh water.

7. The household dishwasher of claim 1, wherein the spray arm is transferable into the first mode or into the second mode via a bayonet lock, a threaded lock or a snap-fit connection.

8. The household dishwasher of claim 1, wherein the spray arm comprises a set of spray nozzles on a top of the spray arm and on a bottom of the spray arm, and wherein the household dishwasher further comprises a valve for causing the set of spray nozzles of the spray arm to turn on or off into the first mode or into the second mode.

9. The household dishwasher of claim 1, further comprising a screening system acted upon by the washing liquor and/or fresh water to clean the screening system, when the spray arm is located in the second mode.

10. The household dishwasher of claim 1, further comprising a sump, said spray arm being supported rotatably on the sump.

11. The household dishwasher of claim 1, further comprising a receptacle, said spray arm being supported rotatably on the receptacle.

* * * * *